US005608288A

United States Patent [19]

Haag

[11] Patent Number: 5,608,288

[45] Date of Patent: Mar. 4, 1997

[54] PLANAR COLD CATHODE LAMP WITH REFLECTING SURFACES

[75] Inventor: Ronald H. Haag, Warren, Mich.

[73] Assignee: General Motos Corporation, Detroit, Mich.

[21] Appl. No.: 419,568

[22] Filed: Apr. 10, 1995

[51] Int. Cl.[6] ..... H01J 61/30

[52] U.S. Cl. ..... 313/612; 313/634

[58] Field of Search ..... 313/634, 317, 313/612, 113, 114; 220/2.1 R

[56] References Cited

U.S. PATENT DOCUMENTS

| | | | |
|---|---|---|---|
| 1,436,308 | 11/1922 | Evans | 313/114 |
| 1,858,497 | 5/1932 | Hall | 313/612 |
| 2,555,749 | 6/1951 | Krefft | 313/109 |
| 3,226,590 | 12/1965 | Christy | 313/109 |
| 3,247,415 | 4/1966 | Martyny | 313/109 |
| 3,253,176 | 5/1966 | Pate et al. | 313/204 |
| 4,234,817 | 11/1980 | Teshima et al. | 313/493 |
| 4,584,501 | 4/1986 | Cocks et al. | 313/493 |
| 5,207,607 | 5/1993 | Nagano et al. | 445/25 |
| 5,220,249 | 6/1993 | Tsukada | 315/246 |
| 5,233,262 | 8/1993 | Lynn et al. | 313/113 |
| 5,479,069 | 12/1995 | Winser | 313/634 |

FOREIGN PATENT DOCUMENTS

| | | | |
|---|---|---|---|
| 2092383 | 9/1993 | Canada | H01J 61/30 |

*Primary Examiner*—Nimeshkumar Patel
*Assistant Examiner*—Michael Day
*Attorney, Agent, or Firm*—Ernest E. Helms

[57] ABSTRACT

An automotive neon-type discharge lamp assembly is provided including two spaced-apart electrodes; an elongated gaseous path having one of the electrodes approximately at each respective end, the path including a first generally semicircular reflector surface body having opposing ends and a center, a pair of second semiparabolic reflector surfaces, each surface having first and second ends, the first ends being joined to the ends of the first reflector surface and the second ends emanating outwardly therefrom; a transparent, generally concave volumetric concentrator positioned generally opposite the first reflector surface and spaced therefrom, the concentrator having first and second ends; and a transparent cover having two segments, each segment connecting an end of the concentrator with the second end of a respective second reflector surface.

6 Claims, 2 Drawing Sheets

PLANAR COLD CATHODE LAMP WITH REFLECTING SURFACES

FIELD OF THE INVENTION

The field of the present invention is that of neon lighting suitable for signal lighting, particularly rear signal lighting, for automotive vehicles.

BACKGROUND OF THE INVENTION

The technology of cold cathode discharge lamps (commonly referred to as neon lights) is relatively well known and has not changed greatly for 50 years. However, several technical challenges have prevented the widespread use of neon lights for rear lighting and signalling applications.

There are three main areas on which to concentrate when considering efficiency within a neon lighting system. The first is the cathode voltage fall, which within a normal neon lamp is approximately 150 volts for a typical electrode pair. The second is the voltage fall within the discharge, which is dependent upon the gas filling, pressure, current density and discharge length. The final area is the optical processing of the light produced, both by a reflector and a lens. The cathode voltage fall is mostly dependent upon the material used for the electrode.

It has been shown that if a discharge is constrained within a small diameter, a higher proportion of the inputted energy is used changing the state of the gas molecules, which then revert back emitting light, than with an unconstrained discharge. However, constriction raises the resistance of the discharge and thus the voltage fall. Therefore, for a given current, the heat produced within a neon light tube will be higher, a factor that is compounded by the reduced surface area. The heat generation can create surface temperature problems for the neon lamp, though its efficacy will be considerably enhanced.

Gas pressure is an important parameter when considering efficiency. In general, the lower the gas pressure, the higher the efficiency, though there is a point below which the efficiency falls again as the number of charge carriers (ions) within the lamp become insufficient to maintain a discharge. However, within the very small tubes necessary to take advantage of the gains mentioned above, the small gas volume available in a low pressure lamp may well cause a very limited life. The above action is caused by some of the gas molecules becoming adsorbed into the electrodes during operation of the lamp, thus reducing the gas pressure. This process is commonly known as gas clean-up and is an important factor in determining the life of a neon-filled discharge lamp.

The optical performance of a lamp package is also an area which promises considerable performance gains. A neon lamp emits light evenly all around it circumference, and to provide the highest efficiency, this must be gathered up and emitted in the appropriate direction for each particular application. In addition, the light must be of the correct color, and to date this has been achieved by filtering through the lens. The color of the lens is also important from the styling point of view, as people generally expect an automotive stop lamp to appear red, even when unlit.

In order to meet the technical challenges discussed above, tube diameters have been reduced, and internal diameters as small as 3 mm are being used. While this causes little problem at lower currents, the desire to design a relatively small lamp requires currents to reach up to 50 mA to achieve the required light output. This has the effect of raising the glass wall temperature up to as high as 180° C. (356° F.), which will melt most plastics. The temperature around the electrode will be even higher, so this is generally unacceptable.

A neon-type discharge lamp also has its life defined by three additional factors: the volume of gas present, which naturally is affected by the pressure; the operating current; and the surface area of the electrodes. Essentially, the aging process occurs as molecules of neon gas are adsorbed into the electrodes. This rate of adsorption increases rapidly with increasing current, once the capacity of the electrode is passed, and this is broadly defined by the available surface area, though it can be affected by the electrodes' configuration. Above this critical point, the electrode will start to sputter, that is, lose material into the discharge, which is then likely to be deposited onto the glass wall around the electrode. This deposition is then likely to trap more molecules of gas, thus reducing the gas pressure still further. Once this process has started, it is likely to accelerate until the gas pressure becomes so low that there are insufficient charge carriers to maintain the discharge, and the lamp will fail.

SUMMARY OF THE INVENTION

To meet the above-noted challenges, the present invention provides a neon lamp suitable for automotive application which improves lighting efficiency while providing a design which improves operational life. The present invention provides an automotive neon lamp having a first semicircular reflector surface joined to a semiparabolic surface. Additionally, the neon lamp of the present invention has a volumetric concentrator which aids in maintaining the position of the electron discharge path of the neon lamp while at the same time allowing for a greater volume of neon, thereby increasing lamp life while retaining better properties of focusability.

The above and other advantages of the present invention will be made more apparent to those skilled in the art as the present invention is explained in greater detail in the following detailed description and accompanying drawings.

DESCRIPTION OF THE PREFERRED EMBODIMENT

Figure 1:
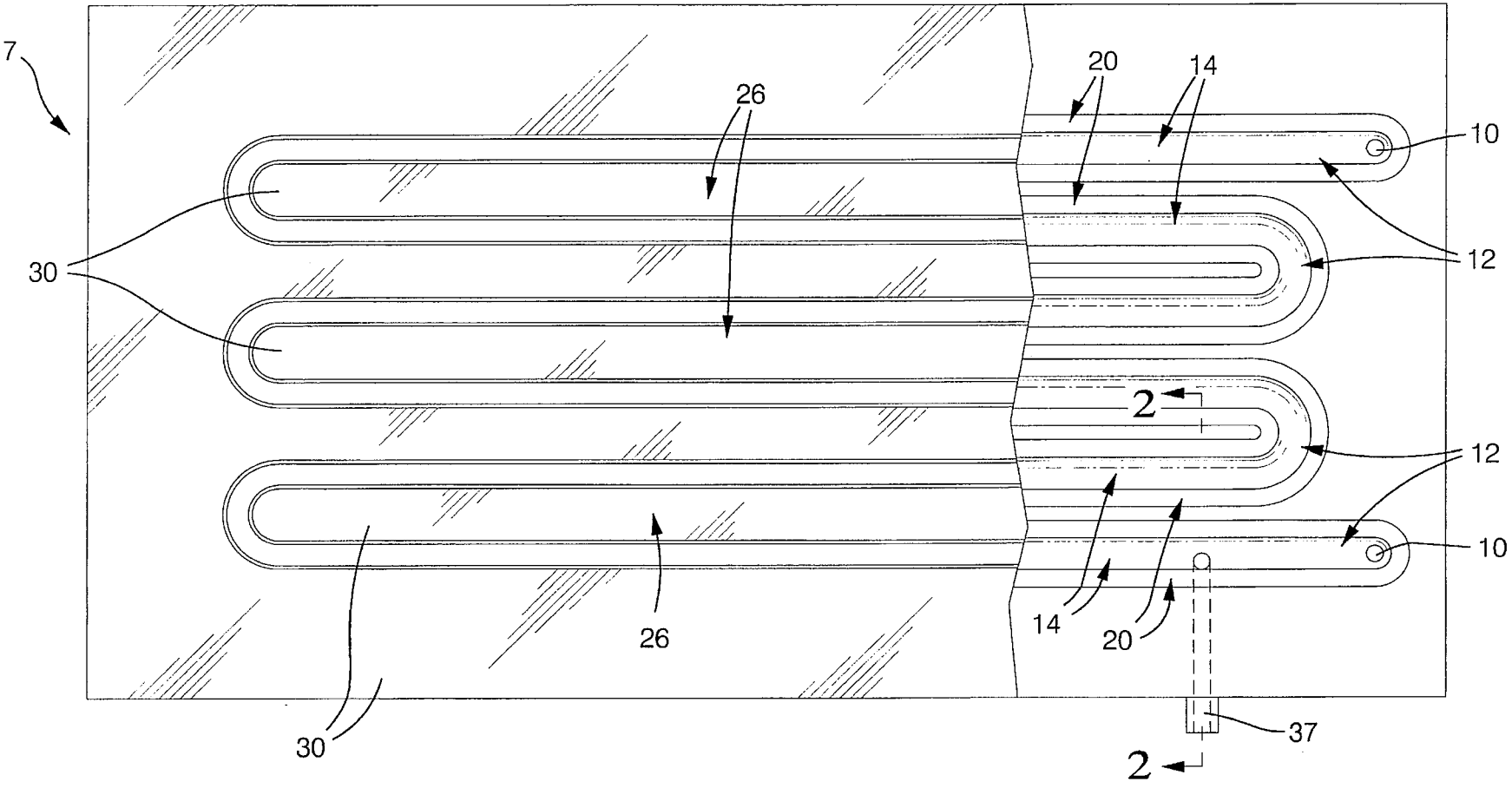
FIG. 1 is a front elevational view, partially sectioned, of a preferred embodiment neon automotive lamp according to the present invention.
Figure 2:
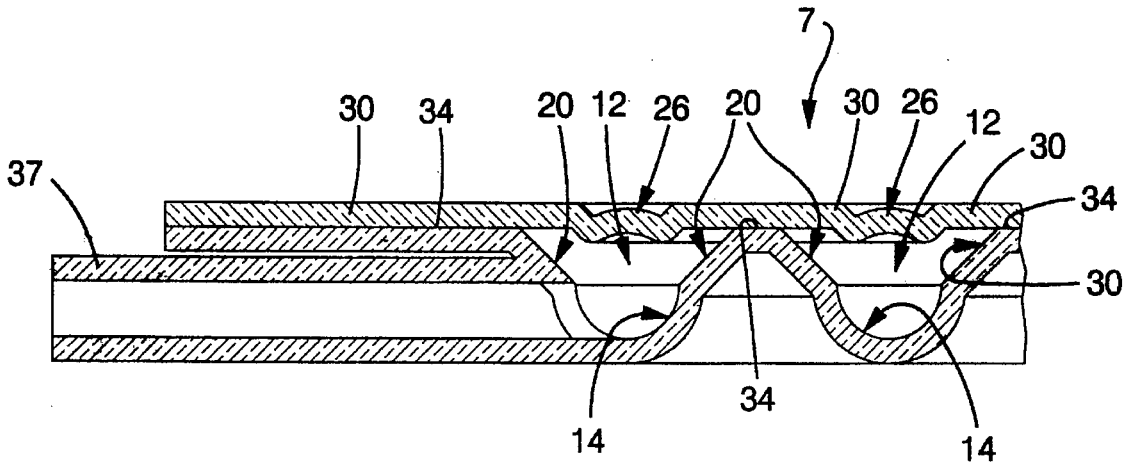
FIG. 2 is a view taken along line 2—2 of FIG. 1.
Figure 3:
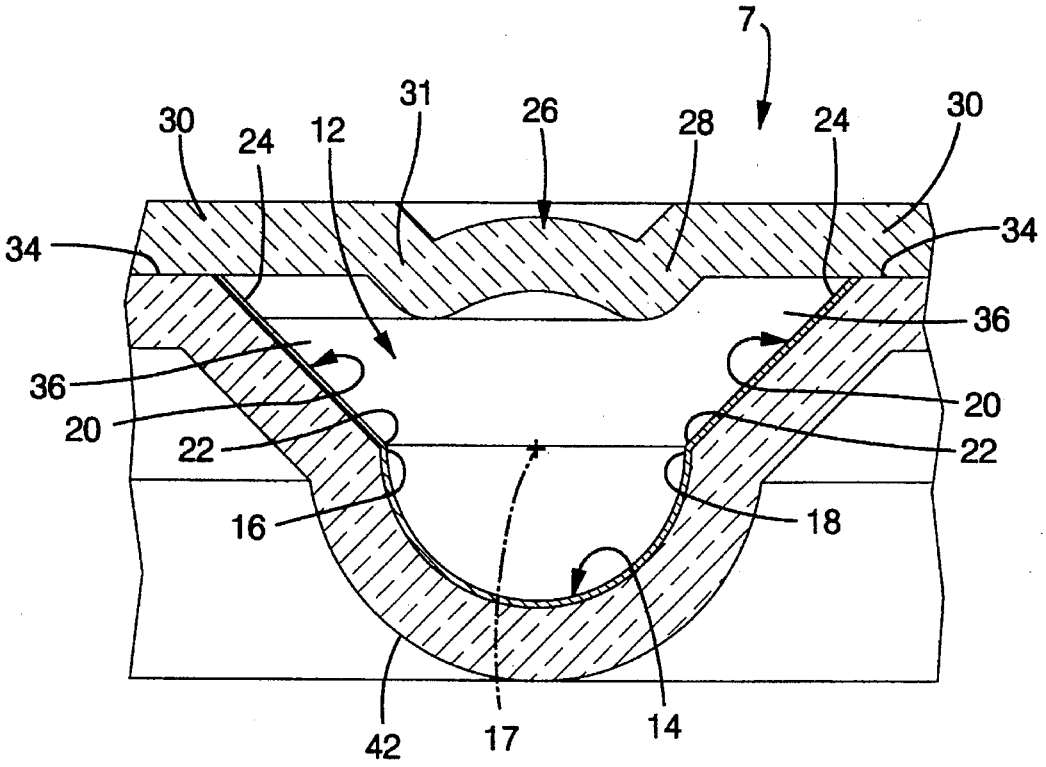
FIG. 3 is an enlarged view of a portion of the automotive lamp assembly shown in FIG. 1.

Referring to FIGS. 1, 2 and 3, the automotive signal lamp 7 according to the present invention is shown in an embodiment of a tail lamp or center high mounted stop lamp (CHMSL). The lamp has two electrodes 10. Each electrode is typically fabricated from iron or a kovar material and has a voltage across the electrode of approximately 150 volts. The electrodes will be connected to a ballast which provides an output wattage which is matched to the discharge lamps specific voltage-current characteristics at the light output desired.

Each electrode 10 is placed at the end of a gaseous path 12. The gaseous path 12 includes a first semicircular reflector surface 14 (formed from a boroscillicite material) having a center 17. The radius of reflector surface 14 is approximately 2.5 mm. Reflector surface 14 has a surface roughness of 10μ in. and typically will be provided with a phosphor coating. The first reflector surface 14 has opposing ends 16 and 18.

Joined to the ends 16 and 18 of the first reflector surface are second semiparabolic reflector surfaces 20. The second reflector surfaces 20 are integrally joined to the first reflector surface 14. The second reflector surfaces have a first end 22, which is joined to the ends 16 and 18 of the first reflector surface, and have a second end 24 emanating outwardly from the junction of the first and second reflector surfaces. A line drawn from end 24 to end 22 of the second reflector surface intersects with a line drawn between the two ends 16 and 18 of the first reflector surface at approximately a 140 degree angle.

Although the second reflector surface 20 is nearly parabolic, it will not be totally parabolic but rather will be formulated to project the light pattern generally required of a stop signal or CHMSL light assembly. The second reflector surface 20 will have a phosphor coating similar to that provided for the first reflector surface 14.

Spaced generally opposite the first reflector surface 14 is a transparent volumetric concave concentrator 26. The concentrator has first and second ends 28 and 31, respectively, which are integrally joined to a multiple part cover 30 which connects the concentrator with the second ends 24 of the second reflector surfaces 20. The concentrator helps to retain the center of the volumetric area of the gaseous path 12 at center 17. The concentrator 26 and cover 30 will typically be integrally formed from a boroscillicite material which is joined to the first and second reflector surfaces 14, 20 along intersection 34 by one of two processes.

There are two possible methods of sealing reflector surfaces 14, 20 to the cover 30. In one method, the reflector surfaces 14, 20 and cover 30 are preformed to the correct shape by sheet forming techniques. Then a small bead of frit material is laid down between each channel and around the outer periphery of the reflector surfaces along surface interface 34. The cover 30 is then aligned on top of the reflector surfaces. The reflector surfaces 14, 20 and cover 30 are then put in a kiln or lehr and slowly brought up to a temperature required for fusing the frit material to the separate glass surface interface 34. The lamp is then brought back to room temperature after a hermetic seal has been achieved.

Another method is to again use a sheet forming method to form the cover 30 and the reflector surfaces 14, 20. Thereafter, cover 30 and reflector surfaces 14, 20 are pressed together while they are still almost in their molten state and fusion occurs to cream a hermetic seal. When such a technique is utilized, the phosphorus coating on the inside reflector surfaces usually cannot be done. Therefore, the opposite side 42 or the outer surfaces of the reflector surfaces 14, 20 will be metalized to achieve a high mirror light reflector surface.

Neon or other low pressure gasses such as argon, helium or a mixture is delivered into the gaseous path via a fill robe. The above is accomplished by connecting the chamber to a manifold and evacuating it to approximately 4–5 mm/Hg. Then a high current is mn through the channel to heat up the electrodes and the gas to remove any impurities or undesired gas. The chamber is then evacuated to $10^{-3}$ mm/Hg to remove the impurities. The chamber is then backfilled with the desired gas (neon) to approximately 20 mm/Hg and sealed by tipping off the glass tube with a flame torch or pinch seal at 37. In operation, the arc will generally be coterminous with the center 17. Light emanating rearwardly (or downwardly as shown in FIG. 3) from the center 17 will impinge upon the first reflector surface 14 and then will either reflect directly into the concentrator 26 or the cover 30 or indirectly into the second reflector surface 20 before contacting the cover 30 or the concentrator 26. Other light which will radiate forwardly or upwardly, depending on the angle given, will hit the second reflector surface 20 or go directly into the concentrator 26 or the cover 30. The total light emitted will be four times greater than the output pattern desired for an automotive signal lamp than if a simple circular tube was utilized. In addition, with the reflector portion of each channel basically touching the reflector portion of the channel next to it, a uniform and evenly distributed light pattern will appear across the surface of the lamp 7, giving a very smooth appearance. Typically, the cover 30 will be tinted to give a red appearance. The addition of the side wings 36 allows the total volumetric amount of gas to be 30 percent higher than if a simple circular tube were utilized. This additional 30 percent volume of gas typically increases the life of the lamp 7 by 30 percent over a more simple circular neon tube design.

While this invention has been described in terms of a preferred embodiment thereof, it will be appreciated that other forms could readily be adapted by one skilled in the art. Accordingly, the scope of this invention is to be considered limited only by the following claims.

What is claimed is:

1. An automotive neon-type discharge lamp assembly comprising:

two spaced-apart electrodes;

an elongated gaseous path having one of the electrodes approximately at each respective end, the path including a first generally semicircular reflector surface body having opposing ends and a center, a pair of second semiparabolic reflector surfaces, each surface having first and second ends, the first ends being joined to the ends of the first reflector surface and the second ends emanating outwardly therefrom;

a transparent, generally concave volumetric concentrator positioned generally opposite the first reflector surface and spaced therefrom, the concentrator having first and second ends; and a transparent cover having two segments, each segment connecting an end of the concentrator with the second end of a respective second reflector surface.

2. An automotive neon-type lamp as described in claim 1 wherein the gaseous path takes a serpentine shape.

3. An automotive neon-type lamp as described in claim 1 used as a center high mounted stop lamp.

4. An automotive neon-type lamp as described in claim 1 wherein the current path is generally coterminous with the center of the semicircle.

5. An automotive neon-type lamp as described in claim 1 wherein the first and second reflector surfaces are integrally joined.

6. An automotive neon-type discharge lamp assembly comprising:

two spaced-apart electrodes;

an elongated serpentine gaseous path having one of the electrodes at one of each respective ends of the gaseous path, the path including:

a first generally semicircular reflector surface body having opposing ends and a center;

a pair of second semiparabolic reflector surfaces having first and second ends, the first ends being integrally joined to the ends of the first reflector surface and the second ends of the second reflector surface emanating outwardly therefrom;

a transparent, generally concave volumetric concentrator positioned generally opposite the first reflector surface and spaced therefrom, the concentrator having first and second ends; and a transparent cover having first and second portions connecting the respective ends of the concentrator with the second ends of the second reflector surface wherein a current path between the electrodes is generally coterminous with the center of the first reflector surface.

* * * * *